United States Patent [19]

Bernhardt

[11] 4,219,269

[45] Aug. 26, 1980

[54] DEVELOPING DRUM FOR PHOTOGRAPHIC MATERIAL

[75] Inventor: Reiner Bernhardt, Bergneustadt, Fed. Rep. of Germany

[73] Assignee: Johannes Bockemuehl, Gummersbach-Derschlag, Fed. Rep. of Germany

[21] Appl. No.: 964,941

[22] Filed: Nov. 30, 1978

[30] Foreign Application Priority Data

Dec. 2, 1977 [DE] Fed. Rep. of Germany ..... 2753743

[51] Int. Cl.[2] ..... G03D 13/02

[52] U.S. Cl. ..... 354/329; 354/307; 354/324; 354/331; 73/322

[58] Field of Search ..... 354/297, 298, 307, 312, 354/313, 314, 315, 316, 323, 324, 328, 329, 330, 331, 334, 337, 338, 333; 73/307, 322; 116/110

[56] References Cited

U.S. PATENT DOCUMENTS

| | | | |
|---|---|---|---|
| 1,812,676 | 6/1931 | Beall | 73/322 |
| 2,738,675 | 3/1956 | Blair | 73/322 |
| 3,359,799 | 12/1967 | Lubin | 73/322 |
| 3,595,158 | 7/1971 | Long | 354/307 |
| 3,677,163 | 7/1972 | Porter | 354/307 |
| 3,846,818 | 11/1974 | Merz | 354/324 |
| 4,035,818 | 7/1977 | King | 354/323 |

FOREIGN PATENT DOCUMENTS

| | | | |
|---|---|---|---|
| 6337 | 9/1895 | Sweden | 73/322 |

*Primary Examiner*—L. T. Hix
*Assistant Examiner*—Alan Mathews
*Attorney, Agent, or Firm*—Michael J. Striker

[57] ABSTRACT

A film-developing tank has a vessel having an opening and being adapted to receive a film to be developed and a developing medium for the film, and a cover axially closing the opening of the vessel. The cover has an axially outer funnel-shaped portion for pouring-in the developing medium therethrough, and an axially inner portion for receiving the developing medium so that the cover simultaneously forms a volume metering container. The outer portion has an inlet and an outlet, and the inner portion surrounds the outlet of the outer portion and is connected with the latter. The inner portion has outlet openings in the region of the opening of the vessel. The cover further has a separate pour-out opening provided in the region of connection of the portions with one another and extending from the interior of the vessel so that the developing medium can pour out from the latter through the pour-out opening. The wall of the outer funnel-shaped portion of the cover is formed as a guiding member with a read-off station, and a measuring rod extends through the guiding member movable relative to the same and has an axially inner end provided with a float in the inner portion of the cover.

6 Claims, 1 Drawing Figure

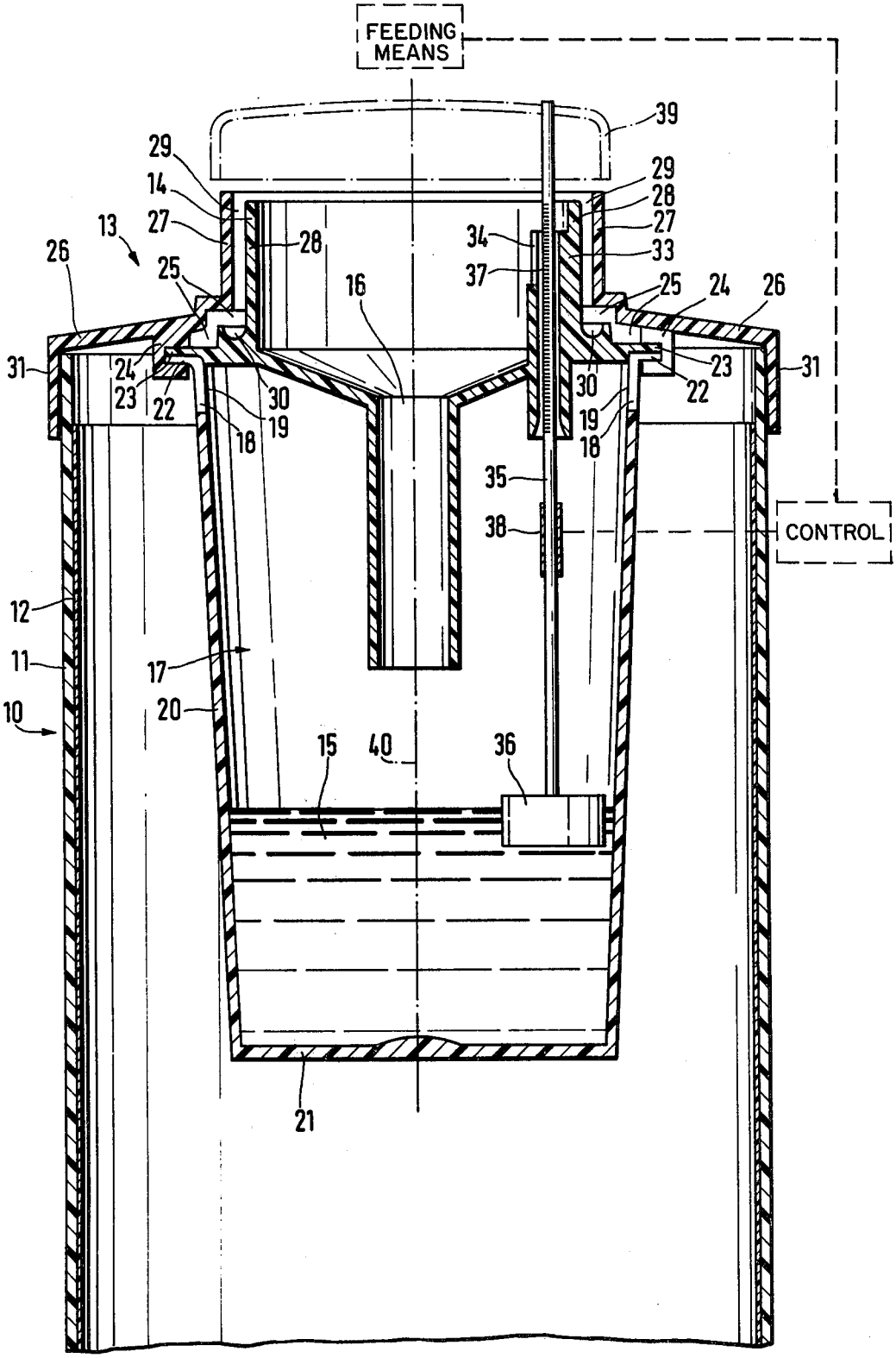
FEEDING MEANS
CONTROL
39
29
14
27
13
26
25
28
16
34
37
33
24
23
22
30
19
18
31
35
38
12
11
10
17
20
15
40
36
21

DEVELOPING DRUM FOR PHOTOGRAPHIC MATERIAL

BACKGROUND OF THE INVENTION

The invention concerns a developing drum for photographic material with an axially closing cover, the cover being fitted externally with a funnel for the filling of photo-chemical working solutions, and internally with a filling cup around the spout of the funnel, the cup having lateral drain openings near the cover.

Working solutions for the processing of photographic material in tank-type developing drums are at temperatures up to 40° C. Besides an expeditious manner of working, this also requires precise maintenance, within the most narrow limits, of both, processing periods and the prescribed temperatures. For an exact adjustment of the processing temperatures, heating equipment is known, where the measured working solutions in bottles are kept at the prescribed temperature in a water bath. For smaller quantities of processing solution such installations are too costly because the entire quantity of the solution has to be heated at one time. With a known device for the measuring of smaller amounts of working solution at the prescribed temperature, the solution is kept in a plastic bottle with a graduate placed on its top. By compressing the bottle, the required amount of solution is pumped into the graduate. In this instance, the working solution within the bottle can be kept warm, but no more that portion transferred into the measuring cup. The working cup will rather be at room temperature, so that a drop in temperature in the portion of solution contained in it, is unavoidable. Furthermore, this method requires constant observation of the scale on the graduate.

SUMMARY OF THE INVENTION

The task of the invention is to enable simple and exact measuring and handling also of smaller quantities of working solutions remaining at an exact temperature. The invention is solving this task by means of a cover designed as measure, containing a movable indicating member connected to a float in the inlet cup, and having at least one measuring mark; the cover has a location where the scale of the indicator can be read off.

In this design the cover is given an entirely new function, namely that of a measuring organ which, on one hand avoids temperature losses and on the other hand obviates the necessity for additional measuring vessels such as graduate cups. The measure, according to the invention, allows convenient reading of the quantity of working solution filled in, and furthermore saves one entire working step because the quantity measure is already arranged within the processing drum, thus eliminating transfer of the working solution into the drum.

In the simplest instance, the indicating member consists of a measuring rod guided within the cover, parallel to the axis of the drum, having a float at its lower end and fitted with a scale. A fixed mark arranged at the reading point allows reading of the respective quantity of solution filled in at one time. As an alternative, the scale can also be arranged on the cover and the fixed indicating mark can be fitted on the measuring rod. The measuring rod is led through the cover within a guiding bushing and can move out of the bushing with its top end, so that the top end of the measuring rod can also be used as measuring mark. A particularly simple method of manufacture can be achieved, when the bushing for guiding the measuring rod is molded onto the wall of the funnel. In this manner, the nozzle of the funnel will have sufficient space to receive the working solution. It is of advantage to have a cut-out, allowing read-off, arranged along at least a section of the shell of the bushing. In this way, the quantity filled-in can be read exactly from the measuring rod fitted with a scale.

When filling the working solution at its exact temperature, the measuring rod with a float at its lower end will move upward, sliding through the guide bushing. The exact amount of the working solution filled-in can then be read from the scale of the measuring rod through the cut-out in the bushing. In order not to have to constantly observe the scale during filling, a further design feature of the invention arranges for a metering mark in the form of a tab that can be adjusted along the length of the measuring rod. The tab can be set to the required amount, by moving it along the shaft already before the filling of the working solution. On filling, the rod with the tab will move upwards through the guiding bushing, and the tab will allow a rather rapid indication at the cut-out. This design is particularly suitable for repeated reading of identical quantities of working solution.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the drawing, the invention is shown in an example of the design in longitudinal section through the cover side of the drum in vertical filling position.

DESCRIPTION OF A PREFERRED EMBODIMENT

In the design example shown, the developing drum 10 consists of a cylindrical drum barrel 11 against which the photographic material 12 is placed, and a cover 13 which closes the drum axially. The cover 13 comprises an external nozzle 14 for the filling of the photographic working solution 15 and an internal filling cup 17 around the funnel spout 16, the filling cup 17 having lateral drains 18 located in the reach of the cover; this arrangement results in ribs 19 being formed and connecting the nozzle 14 with the filling cup 17. The filling cup 17 comprises the conical barrel 20 tapering out towards the top, and the bottom 21. The barrel permits draining the working solution 15 through the drains 18 when the drum 10 is brought into its horizontal working position. The funnel spout 16 extends into the filling cup 17. The filling cup 17 has a rim 22 around its barrel 20 which, together with the flange 23 of nozzle 14 extend into and are held by the groove of the collar 24. Several stepped-off connecting ribs 25 are molded into the flange 23 connecting nozzle 14 with the sloping cover-roof 26. The co-axial arrangement of the cover neck 27 with the ring 28 of funnel 14 forms a double funnel, and a labyrinth passage 29 is formed between the offset neck 27 of cover 26, the funnel ring 28 and elements arranged external to ring 28. These elements comprise, apart from the connecting ribs 25, a groove 30 pointing towards the entrance of labyrinth passage 29. The groove 30 is particularly effective in preventing undesired entry of light into the developing drum 10, and the labyrinth passage 29 serves for draining the developing drum 10 and filling it with the other working solution 15, thus obviating the need to remove cover 13 and permitting simple manipulation in daylight. A gripping rim 31 is molded onto the cover-roof 26 to allow simple jamming-shut of cover 13 against developing drum 10. The gripping rim 31 could also be threaded internally to allow tighter closing.

A longitudinal guiding bushing 33 is molded onto the nozzle ring 28 of nozzle 14 and, to avoid a large section of material, the bushing could also be arranged at a distance from the nozzle ring 28. The guiding bushing has a cut-out 34, the bushing serves for the guiding of measuring rod 35 which has a float 36 attached to its lower end. According to the example shown, the measuring rod 35 extends beyond the neck 27 of cover 13, but may also be of a shorter dimension. The measuring rod 35 may have a scale 37 allowing an exact reading of the filled quantity of working solution 15 through the cut-out 34 in the longitudinal guiding bushing 33. In the present instance, a movable mark 38 in the form of a tab is attached to the measuring rod 35, as shown in the drawing. When the tab emerges behind the cut-out 34, extremely fast reading of the quantity filled is made possible. It is, of course, possible to provide for a different indicating element, fixed or movable, on the measuring rod 35, and the upper end of measuring rod 35 could itself serve as measuring mark.

Upon filling of the indicated amount of photo-chemical working solution 15 through the filling cup 17 into the measure, float 36 will rise from the bottom 21 and the measuring rod 35 will slide upwards through the guiding bushing 33. This will cause either scale 37 on the measuring rod 35, or measuring mark 25, to appear behind the cut-out 34 so that the prescribed filling quantity can be read off. Then, the developing drum 10 is closed by means of top cover 39 and inserted into a processor housing not shown in the drawing. When transferring the devloping drum into the processor housing, the drum is also tilted from the vertical filling and measuring position into its horizontal working position. During tilting, the metered quantity of working solution 15 will flow through the drains 18 in the barrel 20 of the developing drum 10 and thus onto the photographic material 12. Upon inserting the developing drum 10 into the processor housing, the end opposite cover 13 can, for instance, be coupled by a magnetic clutch to a shaft and be rotated around the drum axis 40.

The design shown is, as already noted, only an example of a realization of the invention, and it is not restricted thereto. It is possible to replace measuring rod 35 by a lever which would also serve as controlling organ to shut-off the fluid feed, or the rising measuring rod 35 could act mechanically and actuate electronic devices to shut off pouring from a storage container. By this method, read-off would be replaced by an automatic and exact quantity measuring.

It will be understood that each of the elements described above, or two or more together, may also find a useful application in other types of constructions differing from the types described above.

While the invention has been illustrated and described as embodied in a film-developing tank, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A film-developing tank, comprising a vessel having an axis and an opening and being adapted to receive a film to be developed and a developing medium for the film; a cover axially closing said opening and having an axially outer funnel-shaped portion for pouring-in the developing medium therethrough and an axially inner portion for receiving the developing medium so that said cover simultaneously forms a volume metering container, said outer portion having an inlet and an outlet, and said inner portion surrounding said outlet of said outer portion and being connected with the latter, said inner portion having outlet openings in the region of said opening of said vessel, said cover having a separate pour-out opening provided in the region of connection of said portions with one another and extending from the interior of said vessel so that the developing medium can pour out from the latter through said pour-out opening; and measuring means for measuring the amount of the developing medium in said outer funnel-shaped portion of said cover and indicating means for indicating when a predetermined amount of the developing medium has been introduced in the same, said measuring means including a wall of said outer funnel-shaped portion of said cover which is formed as a guiding member with a read-off station, and a measuring rod extending through said guiding member movable relative to the same and having an axially inner end provided with a float in said inner portion of said cover.

2. A film-developing tank as defined in claim 1, wherein said indicating means includes a dial marked in volumetric units on said measuring rod, said guiding member having a through-going passage through which said measuring rod extends and a window located in the region of said passage and forming said read-off station.

3. A film-developing tank as defined in claim 1, wherein said indicating means includes a measuring mark which is adjustable along the elongation of said measuring rod.

4. A film-developing tank as defined in claim 3, said adjustable measuring mark together with said measuring rod being movable through said passage of said guiding member.

5. A film-developing tank as defined in claim 1; and further comprising actuating means including an element which is guided on and adjustable along the elongation of said measuring rod and formed as a control member operative for automatically interrupting the pouring-in of the developing medium into said cover.

6. A film-developing tank as defined in claim 1, wherein said cover has a further portion which radially outwardly surrounds said inner portion and forms said pour-out opening radially outside of the latter, said pour-out opening being formed as a labyrinth passage.

* * * * *